United States Patent [19]

McBride

[11] Patent Number: 5,004,112

[45] Date of Patent: Apr. 2, 1991

[54] TAMPER-INDICATING PLASTIC CLOSURE

[75] Inventor: Stephen W. McBride, Brownsburg, Ind.

[73] Assignee: H-C Industries, Inc., Crawfordsville, Ind.

[21] Appl. No.: 507,301

[22] Filed: Apr. 10, 1990

[51] Int. Cl.[5] ..... B65D 41/34

[52] U.S. Cl. ..... 215/252

[58] Field of Search ..... 215/252, 253, 258

[56] References Cited

U.S. PATENT DOCUMENTS

| | | | |
|---|---|---|---|
| 4,401,227 | 8/1983 | Pehr . | |
| 4,402,418 | 9/1983 | Ostrowsky . | |
| 4,418,828 | 12/1983 | Wilde et al. . | |
| 4,469,234 | 9/1984 | Duessen . | |
| 4,497,765 | 2/1985 | Wilde et al. . | |
| 4,506,795 | 3/1985 | Herr . | |
| 4,520,939 | 6/1985 | Itsubo et al. | 215/252 |
| 4,545,496 | 10/1985 | Wilde et al. | 215/252 |
| 4,550,843 | 11/1985 | Nolan . | |
| 4,550,844 | 11/1985 | Lininger . | |
| 4,565,295 | 1/1986 | Mori et al. | 215/252 |
| 4,588,100 | 5/1986 | Itsubo et al. . | |
| 4,592,476 | 6/1986 | Yasada | 215/252 |
| 4,635,808 | 1/1987 | Nolan . | |
| 4,664,279 | 5/1987 | Obrist et al. . | |
| 4,666,053 | 5/1987 | Corcoran et al. | 215/252 |
| 4,674,643 | 6/1987 | Wilde et al. | 215/252 |
| 4,784,280 | 11/1988 | Breuer et al. . | |
| 4,801,030 | 1/1989 | Barriac . | |

FOREIGN PATENT DOCUMENTS

| | | |
|---|---|---|
| 56-74445 | 6/1981 | Japan . |

*Primary Examiner*—Stephen Marcus
*Assistant Examiner*—Stephen K. Cronin
*Attorney, Agent, or Firm*—Dressler, Goldsmith, Shore, Sutker & Milnamow, Ltd.

[57] ABSTRACT

A tamper-indicating plastic closure for a container comprises a plastic closure cap having a circular top wall portion, and a depending annular skirt portion. The closure further includes an annular pilfer band depending from the skirt portion which is at least partially detachably connected thereto by a frangible connection. The pilfer band includes a plurality of circumferentially spaced flexible projections, and a plurality of respectively associated interference beads. By this arrangement, the pilfer band is configured for two modes of interfering engagement with an annular locking ring of an associated container for at least partially separating the pilfer band from the closure skirt for tamper-indication.

10 Claims, 2 Drawing Sheets

TAMPER-INDICATING PLASTIC CLOSURE

TECHNICAL FIELD

The present invention relates generally to tamper-indicating closures for containers, and more particularly to a threaded, tamper-indicating closure for use on a container having an annular locking ring, wherein the closure includes a pilfer band having a plurality of angularly disposed flexible projections, and a plurality of respective interference beads.

BACKGROUND OF THE INVENTION

Tamper-indicating or tamper-evident packaging for food products, beverages, and the like, desirably acts to assure consumers of the purity and freshness of such products. Typically, such packaging arrangements are configured to provide clearly visually discernible evidence that a package or container has been partially or completely opened.

One such tamper-evident arrangement is disclosed in U.S. Pat. No. 4,418,828. This patent discloses a tamper-indicating plastic closure particularly suited for use with bottles or like containers. The closure of this patent has proven to be quite commercially successful, since it has been configured for highly efficient and reliable use with conventionally configured containers having a threaded neck, and an annular, flange-like locking ring.

While it is generally desirable to enhance the tamper-resistent characteristics of a container closure, such improvements must be weighed against the practicalities of consumer acceptance, economic feasibility, and mass production. The present invention is directed to an improved form of the tamper-indicating closure of the above patent, which improvement desirably enhances tamper-resistance, while facilitating high-speed manufacture and convenient consumer use.

SUMMARY OF THE INVENTION

The tamper-indicating plastic closure of the present invention includes a pilfer band arrangement having an annular band portion, and a plurality of inwardly extending, preferably angularly disposed flexible projections which cooperate with the annular locking ring of an associated container. The flexible projections are configured to cooperate and function in two different ways with the associated container, thus providing two modes of tamper-evidence. This is achieved by providing a plurality of interference beads in respective association with the flexible projections, whereby the flexible projections interferingly engage the container locking ring irrespective of their disposition relative to the annular band portion.

In the illustrated embodiment, the present tamper-indicating closure includes a plastic closure cap having a circular top wall portion, and a depending cylindrical skirt portion. The closure further includes an annular pilfer band depending from and at least partially detachably connected to the skirt portion by a frangible connection. In the illustrated, preferred form, this frangible connection comprises a plurality of circumferentially spaced frangible ribs extending between the inside surfaces of the closure cap and an annular band portion of the pilfer band.

The pilfer band of the closure includes a plurality of circumferentially spaced, inwardly extending flexible projections. Each flexible projection is preferably generally planar, with each having an edge portion joined to a band portion of the pilfer band at an acute angle relative to the vertical axis of the closure. By this construction, each of the projections is movable about a respective, non-horizontal hinge arrangement. The projections are thus movable to an out-of-the-way disposition during application of the closure to an associated container, with the projections thereafter resuming a generally inwardly extending disposition to provide the desired interfering interaction with the container locking ring.

The flexible projections normally function in this initial orientation to effect fracture of the frangible ribs joining the pilfer band to the closure cap. However, the present invention contemplates that the flexible projections can further function to interferingly engage the container locking ring in another manner to provide a second mode of failure.

To this end, the pilfer band of the closure further includes a plurality of circumferentially spaced interference beads respectively operatively associated with the inwardly extending flexible projections. While the configuration of each interference bead can vary while keeping with the principles disclosed herein, in the illustrated embodiment, each interference bead has a generally elongated configuration, and extends along the inside surface of the annular band portion of the pilfer band at an acute angle parallel to the respective one of the flexible projections.

The relative dimensioning of the flexible projections and the interference beads is such that they can cooperate to provide interfering engagement with the container locking ring in the second mode of failure of the pilfer band. Specifically, in the event that the flexible projections are moved from their initial inwardly extending disposition, such as by the inadvertent formation of an excessively strong frangible connection to the closure skirt, or by unauthorized manipulation of the projections, the projections assume a disposition whereby they are respectively engageable with the associated interference beads. In this second orientation, the combined thickness of the interference beads and the flexible projections define an effective inside diameter for the pilfer band which diameter is less than the outside diameter of the container locking ring. As a consequence, interfering engagement between the pilfer band and the locking ring is assured attendant to closure removal, whereby the frangible ribs connecting the pilfer band to the closure skirt are fractured in the desired manner.

Other features and advantages of the present invention will become readily apparent from the following detailed description, the accompanying drawings, and the appended claims.

DETAILED DESCRIPTION

Figure 1:
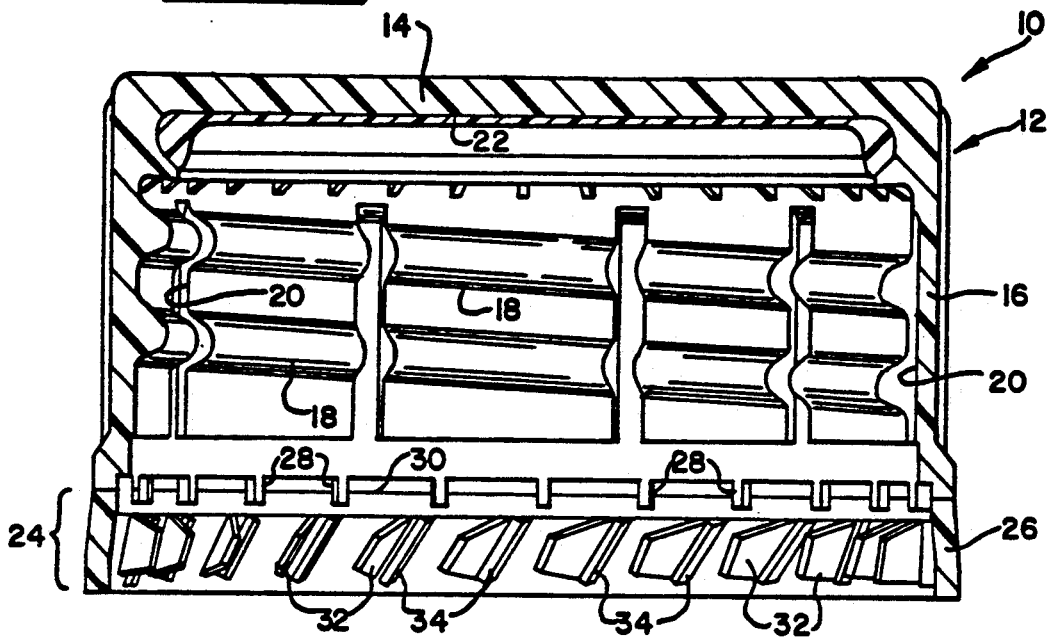
FIG. 1 is a cross-sectional, side elevational view of a tamper-indicating plastic closure embodying the principals of the present invention.

While the present invention is susceptible of embodiment in various forms, there is shown in the drawings and will hereinafter be described a presently preferred embodiment, with the understanding that the present disclosure is to be considered as an exemplification of the invention, and is not intended to limited the invention to the specific embodiment illustrated.

With reference now to the drawings, therein is illustrated a tamper-indicating plastic closure 10 embodying the principles of the present invention. As illustrated, closure 10 is generally cup-shaped, and includes a closure cap 12 having a circular top wall portion 14, and a depending, cylindrical annular skirt portion 16.

Skirt portion 16 has an internal thread formation 18 on the inside surface thereof for engagement and cooperation with a container C to which the closure is fitted In the preferred form, the skirt portion 16 defines a plurality of axially extending vent grooves 20 which generally traverse the thread formation 18. Vent grooves 20 facilitate the release and venting of gas pressure when the closure 10 is used with the container C to package carbonated beverages or the like. In this regard, the closure includes a circular sealing liner 22 positioned adjacent top wall portion 14, with the sealing liner 22 configured for sealing engagement with the container C.

The closure 10 can be very efficiently formed by compression molding, such as in accordance with the teachings of U.S. Pat. No. 4,497,795, the teachings of which are herein incorporated by reference.

In order to provide visually discernable evidence that the closure 10 has been partially or completely removed from the associated container C, the closure includes an annular pilfer band 24 configured for cooperating engagement with a flange-like annular locking ring L on the exterior finish of container C. Notably, pilfer band 24 is configured to be self-engaging with the locking ring L, that is, the pilfer band does not require any post-application processing to render it effective for tamper-indication. Additionally, the tamper-resistance of the present closure is enhanced in that it is configured to provide two modes of interfering engagement with the container locking ring L, thus assuring at least partial separation of the pilfer band from the closure skirt 16, as will be further described.

The pilfer band 24 includes a continuous annular band portion 26 which is at least partially detachably connected to the skirt portion 16 of closure cap 12 by a plurality of circumferentially spaced frangible ribs 28. Frangible ribs 28 extend between the inside surfaces of the skirt portion 16 and the pilfer band.

In order to provide a frangible connection between the pilfer band and the closure skirt portion, the skirt portion 16 and the pilfer band 24 are distinguished and separated from each other by a score line 30 extending circumferentially of the closure. The score line extends through the integrally molded closure, thereby separating the pilfer band 24 from the skirt portion 16, with the score line extending partially into the frangible ribs 28. Thus, the "residual" unscored portion of the frangible ribs provide a frangible connection between the pilfer band and the skirt portion.

For those applications where it is desired that the pilfer band 24 remain on the associated container after removal of closure cap 12, the score line 30 preferably extends completely about the closure, thus completely separating and distinguishing the pilfer band 24 from the closure skirt. For those applications where it is desired to have the pilfer band remain attached to the closure cap 12 attendant to removal, an unscored, connector portion can be provided which joins the pilfer band to the closure cap. Alternately, one or more relatively "oversized" ribs can be provided on the inside surfaces of the skirt portion and the pilfer band, with the score line 30 extending completely about the closure; the oversized ribs thus provide a connector portion, even though scored, by virtue of the relatively large residual portions defined thereby. When it is intended that the pilfer band remain joined to the closure cap attendant to removal, it is desirable to provide one or more regions of the pilfer band which are preferentially weakened, such as by vertical scoring, whereby the pilfer band splits or separates.

In order to provide a first mode of interfering engagement between the pilfer band 24 and the associated container locking ring, the pilfer band includes a plurality of circumferentially spaced, inwardly extending flexible projections 32. Each of the projections 32 preferably has a generally planar configuration, with each of the projections arranged at an acute angle relative to the vertical axis of the closure. By this construction, each flexible projection 32 is configured for hinging movement generally about its edge joined to band portion 26, with each projection thus movable about a non-horizontal hinge arrangement. The projections 32 are generally configured in accordance with the teachings of U.S. Pat. No. 4,418,828, the teachings of which are herein incorporated by reference.

Figure 4:
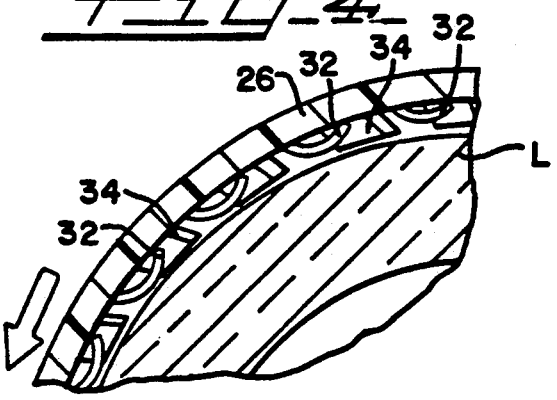
FIG. 4 is a fragmentary, cross-sectional view similar to FIG. 3 illustrating application of the present closure to the associated container.
Figure 5:
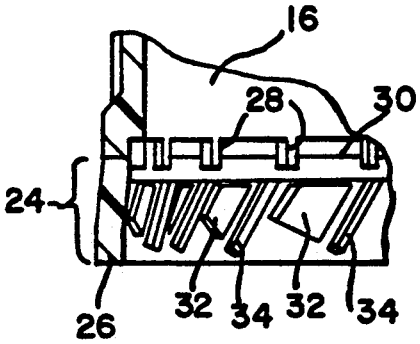
FIG. 5 is a fragmentary, cross-sectional view further illustrating a pilfer band of the present tamper-indicating closure.

The preferred angular disposition of each flexible projections 32, together with the relative dimensioning of each projection, configure the pilfer band 24 for a self-engaging action with the associated container C. Specifically, attendant to closure application, the flexible projections 32 assume a generally upwardly extending, out-of-the-way orientation as the closure is threaded onto the container. As illustrated, the flexible projections 32 are preferably molded in a non-radial orientation whereby they extend in a direction away from the direction of rotation for threading the closure onto the associated container. FIG. 4 generally illustrates the disposition of the projections 32 as the closure 12 is applied to the container, with this movement of the projections providing sufficient clearance for movement of the pilfer band past the container locking ring L without unintended failure of frangible ribs 28.

Figure 2:
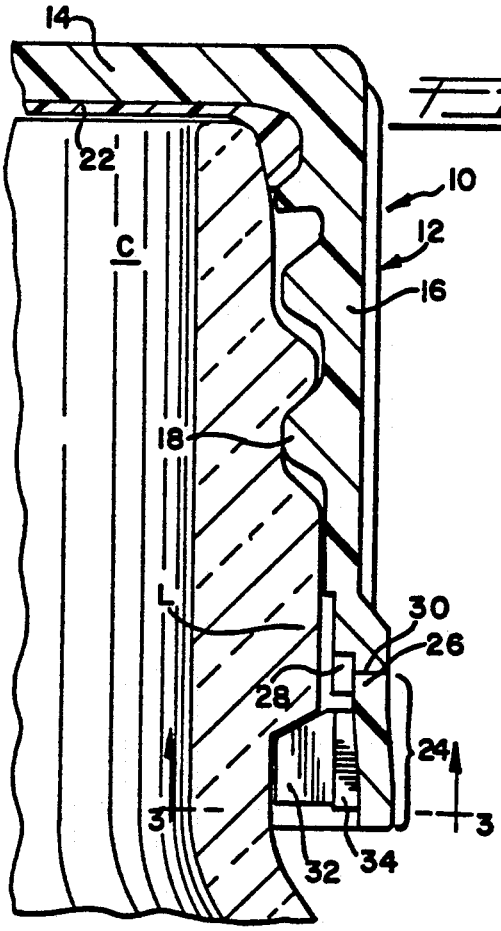
FIG. 2 is a fragmentary, cross-sectional view illustrating the closure of FIG. 1 in position on an associated container.
Figure 3:
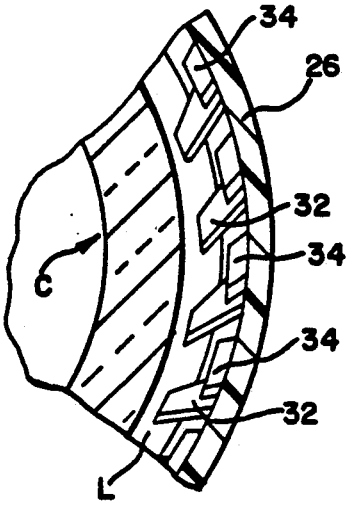
FIG. 3 is a cross-sectional view taken along lines 3—3 of FIG. 2.

The pilfer band 24 is self-engaging in the sense that once fully applied to the container, the flexible projections 32 again assume their generally inwardly-extending disposition (FIGS. 2, 3). The projections 32 are thus positioned for interfering engagement with the locking ring L, and the portion of the container immediately below and adjacent the locking ring. In accordance with the teachings of the above-noted U.S. Pat. No.

4,418,828, this interfering action is achieved by engagement of the upper edge portion of each flexible projection 32 with the lower surface of the container locking ring L. Attendant to this engagement, the angular disposition of each flexible projection 32 results in the free end portion of each projection being urged into engagement with the portion of the container adjacent to and below the locking ring L. This action creates sufficient resistance to the removal of the closure so as to result in fracture of frangible ribs 28, whereby the pilfer band 24 at least partially separates from the closure cap to provide visually discernable evidence of opening.

In accordance with the present invention, a further mode of interfering engagement between the pilfer band 24 and the container locking ring is provided for enhanced tamper-resistance. Specifically, the pilfer band 24 further includes a plurality of interference beads 34 which are respectively associated with the flexible projections 32. In accordance with the illustrated embodiment, each of the interference beads 34 has a generally elongated, rectangular configuration, with each bead 34 preferably arranged in closely spaced and parallel relation to the respective one of the angularly disposed flexible projections 32. This preferred configuration facilitates simultaneous molding of the projections 32 and the beads 34 in a rotatable sleeve element of a molding apparatus, in accordance with U.S. Pat. No. 4,497,765.

As will be appreciated, the interference beads 34 are respectively associated with the flexible projections 32 so as to avoid engagement with the projections during application of the closure 10 to container C (see FIG. 4). In contrast, the beads 34 are respectively engageable with the projections 32 in the event the projections are moved or "flipped" to a relatively reversed position, wherein the projections extend generally in the direction of rotation of the closure during application. Thus, each bead 34 is positioned along the side of the respective projection 32 which is opposite to the side of the projection which is urged toward the inside surface of annular band portion 26 during closure application, i.e., along the side opposite the direction the projection generally extends during closure application.

As noted above, pilfer band 24 functions in its first mode of interfering engagement with the container locking ring L when the flexible projections 32 extend generally inwardly, with this orientation illustrated in FIGS. 1–3 and 5. However, in the event that the flexible projections are moved from this initial disposition, the pilfer band 24, including interference beads 34, is configured to further effect interfering engagement with the container locking ring. Such movement of the projections 32 can occur attendant to closure removal if the frangible connection provided by frangible ribs 28 is inadvertently excessively strong (such as by insufficient scoring at score line 30), or by unauthorized manipulation of the projections 32.

Figure 6:
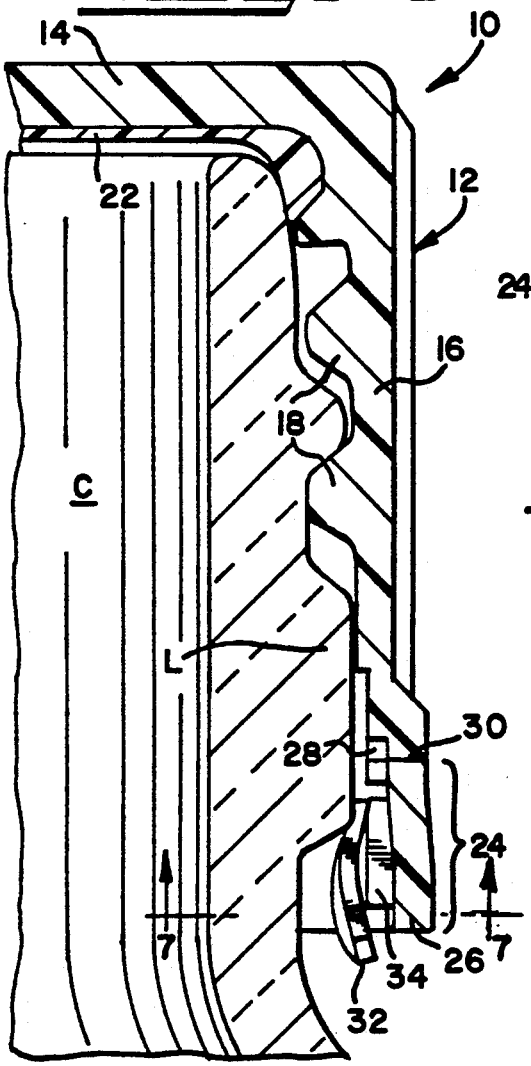
FIG. 6 is a fragmentary, cross-sectional view similar to FIG. 2 illustrating removal of the present closure from the associated container.
Figure 8:
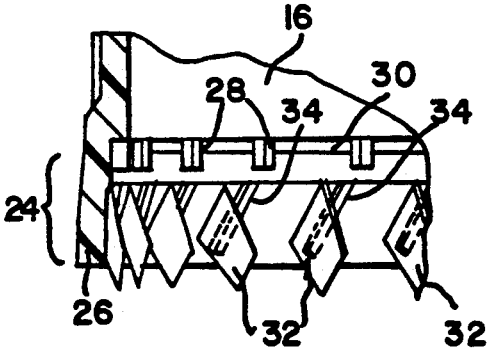
FIG. 8 is a fragmentary, cross-sectional view further illustrating the pilfer band of the present tamper-indicating closure
Figure 7:
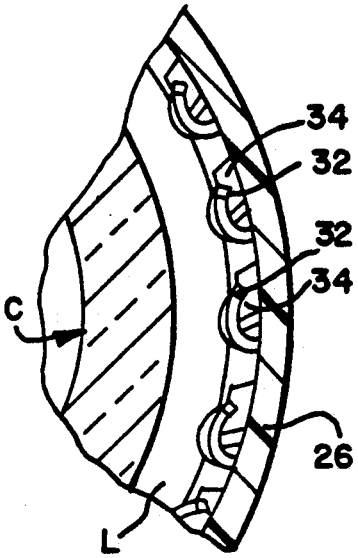
FIG. 7 is a cross-sectional view taken along lines 7—7 of FIG. 6.

This second position of the projections 32 is illustrated in FIGS. 6–8. In this second position, wherein the projections extend inwardly, and generally downwardly (by virtue of the angular hinge arrangement of each projection), the planar surface of each projection generally adjacent its respective interference bead 34 is positioned for engagement with the interference bead. Thus, attendant to closure removal, each interference bead 34 and its respective flexible projection 32 cooperate to provide a combined thickness which effects interfering engagement between the pilfer band 24 and the lower surface of the container locking ring L. By virtue of this further interfering engagement, a second mode of failure is provided whereby frangible ribs 28 are fractured to at least partially separate pilfer band 24 from the skirt portion 16.

In effect, the provision of interference beads 34 in combination with the flexible projections 32 permits the pilfer band to function to fracture frangible ribs 28 irrespective of the disposition of the projections 32 relative to the band portion 26. In other words, the desired fracture is effected whether the projections are in their initial, inwardly extending disposition generally beneath locking ring L (without engagement between the projections and beads 34), or in a relatively "reversed", generally downwardly extending disposition, generally beneath the locking ring L and in respective engagement with the interference beads 34.

From the foregoing, it will be observed that numerous modifications and variations can be effected without departing from the true spirit and scope of the novel concept of the present invention. It is to be understood that no limitation with respect to the specific embodiment illustrated herein is intended or should be inferred. The disclosure is intended to cover, by the appended claims, all such modifications as fall within the scope of the claims.

What is claimed is:

1. A tamper-indicating closure for a container having an annular locking ring, comprising:

a plastic closure cap having a circular top wall portion, and a depending cylindrical skirt portion; and an annular pilfer band depending from and at least partially detachably connected to said skirt portion by frangible means, said pilfer band including a plurality of circumferentially spaced, inwardly extending flexible projections, each of said projections being movable about respective, non-horizontal hinge means, said pilfer band further including interference means operatively associated with said circumferentially spaced flexible projections, said flexible projections being engageable with said interference means during removal of said closure from said container for fracturing said frangible means.

2. A tamper-indicating closure in accordance with claim 1, wherein said interference means comprises a plurality of interference beads respectively operatively associated with said flexible projections.

3. A tamper-indicating closure in accordance with claim 2, wherein each of said flexible projections is movable about respective hinge means disposed at an acute angle relative to the vertical axis of said closure.

4. A tamper-indicating closure in accordance with claim 3, wherein said pilfer band comprises an annular band portion, each of said flexible projections including an edge portion joined to said band portion and disposed at said acute angle.

5. A tamper-indicating closure in accordance with claim 4, wherein each of said interference beads has a generally elongated configuration, and extends along the inside surface of said annular band portion at said acute angle parallel to the respective one of said flexible projections.

6. A tamper-indicating closure in accordance with claim 1, wherein said frangible means comprises a plurality of circumferentially spaced frangible ribs extending between the inside surfaces of said closure cap and said pilfer band, said closure cap and said pilfer band being at least partially separated and distinguished from each other by circumferential score means extending through said closure and partially into said frangible ribs.

7. A tamper-indicating closure in accordance with claim 1, including a sealing liner positioned inside said closure cap adjacent to said top wall portion.

8. A tamper-indicating closure for a container having an annular locking ring, comprising:

a plastic closure cap having a circular top wall portion, and a depending cylindrical skirt portion having an internal thread formation; and an annular pilfer band depending from and at least partially detachably connected to said skirt portion by frangible means, said pilfer band including an annular band portion, and a plurality of circumferentially spaced flexible projections extending inwardly of said annular band portion, each of said flexible projections including an edge portion joined to said annular band portion at an acute angle relative to the vertical axis of said closure whereby each said flexible projection is movable about respective hinge means disposed at said acute angle, said pilfer band further including interference means comprising a plurality of interference beads on the inside surface of said annular band portion respectively operatively associated with said flexible projections for respective engagement therewith, whereby said flexible projections are engageable with said container locking ring during removal of said closure from said container for fracturing said frangible means irrespective of the disposition of said relative flexible projections to said annular band portion of said pilfer band.

9. A tamper-indicating closure in accordance with claim 8, wherein said frangible means comprise a plurality of circumferentially spaced frangible ribs extending between the inside surfaces of said closure cap and said pilfer band, said closure cap and said pilfer band being at least partially separated and distinguished from each other by circumferential score means extending through said closure and partially into said frangible ribs.

10. A tamper-indicating closure in accordance with claim 9, wherein each of said interference beads has a generally elongated configuration, and extends along the inside surface of said annular band portion at said acute angle parallel to the respective one of said flexible projections.

* * * * *